United States Patent [19]

Barrash

[11] Patent Number: 4,487,319

[45] Date of Patent: Dec. 11, 1984

[54] CORRUGATED CARDBOARD CONTAINER HAVING A PAPERBOARD TOP AND HANDLE

[75] Inventor: Marshall J. Barrash, Atlanta, Ga.

[73] Assignee: The Coca-Cola Company, Atlanta, Ga.

[21] Appl. No.: 160,478

[22] Filed: Jun. 18, 1980

[51] Int. Cl.[3] ..... B65D 5/54; B65D 5/32

[52] U.S. Cl. ..... 206/602; 206/427; 229/15; 229/23 R; 229/52 A

[58] Field of Search ..... 206/602, 199, 141, 427, 206/434; 229/52 BC, 52 A, 23 R, 15

[56] References Cited

U.S. PATENT DOCUMENTS

| | | | |
|---|---|---|---|
| 1,492,100 | 4/1924 | Krueger | 229/52 A |
| 2,138,336 | 11/1938 | Bronstein | 229/52 A |
| 2,359,986 | 10/1944 | Grecco | 206/602 |
| 2,514,858 | 7/1950 | Gray | 229/52 BC |
| 2,787,409 | 4/1975 | Vogt | 206/602 |
| 2,812,853 | 11/1957 | Cameron | 206/602 |
| 2,863,598 | 12/1958 | Currie | 206/141 |
| 3,221,876 | 12/1965 | Currie | 206/602 |
| 3,339,820 | 9/1967 | Krzyzonouski | 206/620 |
| 3,339,824 | 9/1967 | Luke | 229/52 A |
| 3,447,733 | 6/1969 | Smith | 206/602 |
| 3,677,458 | 7/1972 | Gosling | 206/602 |
| 4,256,223 | 3/1981 | Pawlowski | 206/602 |

*Primary Examiner*—William Price
*Assistant Examiner*—Gary E. Elkins
*Attorney, Agent, or Firm*—Birch, Stewart, Kolasch & Birch

[57] ABSTRACT

A corrugated cardboard container is disclosed which includes a top handle assembly. The top handle assembly is formed from a relatively light paperboard product and is then applied to the corrugated cardboard container after the cardboard container is assembled. This system has the advantage of using relatively inexpensive paperboard to form the top of the container and handle which are subject to less stress than the bottom of the container which must be formed of the corrugated cardboard. Not only does the container of the present invention utilize a smaller amount of the relatively expensive corrugated cardboard material, but the use of the paperboard as the container top allows advertizing indicia and uniform product code information to be applied directly on the top of the carton. This is not possible in standard corrugated cardboard cartons because the corrugated cardboard does not accept ink in a satisfactory manner. Also disclosed is the use of a viewing window and a split package design in connection with the novel top of the present invention.

31 Claims, 3 Drawing Figures

CORRUGATED CARDBOARD CONTAINER HAVING A PAPERBOARD TOP AND HANDLE

BACKGROUND OF THE INVENTION

1. Field of Invention

The present invention relates to a container designed to be used for the transportation, storage and display of consumer items, such as bottled beverages. More specifically, the present invention relates to a corrugated cardboard container having a paperboard top and handle assembly attached thereto.

2. Description of Prior Art

The use of corrugated cardboard boxes as shipping and storage containers is well-known. These boxes are used to transport various goods from the manufacturer to the distributor, and also to store these goods prior to display and sale. However, many of these prior art corrugated cardboard boxes are not suitable for retail display purposes because the contents of the boxes were not readily visible, and because the corrugated cardboard box surfaces do not accept inks for printing trademark and advertising indicia thereon in a satisfactory manner. That is, the texture of corrugated cardboard, which is brown and rough, does not lend itself to printing of colorful indicia or logo thereon. Also, in the prior art type of corrugated cardboard packages or container, the top of the package was produced from the same relatively heavy gauge cardboard from which the bottom was produced. While the top of the box did not require the strength or rigidity required by the bottom, ease of construction dictated the use of the same gauge cardboard for the box top. Because heavy gauge cardboard is more expensive than lighter gauge materials, a package made exclusively from heavy gauge cardboard is more costly than necessary.

SUMMARY OF THE INVENTION

Accordingly, it is a primary object of the present invention to provide an improved corrugated cardboard container or package with a paper board top which may be used for shipping, storage and display of the contents thereof.

It is another object of the present invention to provide a container with corrugated cardboard sidewalls and bottom and a top portion of a different type of material on which advertising indicia or logo may be easily printed.

It is a further object of the present invention to provide a corrugated cardboard container which may be produced less expensively and still have the necessary strength requirements.

It is a further object of the present invention to provide a corrugated cardboard container having a top and handle of lighter gauge material than the main body thereof.

It is still a further object of the present invention to provide a corrugated cardboard container which may be separable into at least two smaller containers to facilitate the sale of the contents of the containers in relatively small quantities, while still allowing shipment and storage of the containers in larger quantities.

The objects of the present invention are fulfilled in part by virtue of the use of a container top which is formed from a single sheet of paperboard or similar light weight materials. This paperboard top includes a handle flap portion, a top portion, and a pair of securing edge portions which are attached to two opposite sidewalls of the corrugated cardboard container by use of an adhesive. Not only is the lighter weight paperboard top less expensive to produce than a corrugated cardboard container top, but the finish or surface texture on paperboard allows trademark and advertising indicia as well as uniform product code information to be imprinted on the container without the addition of separate paper labels.

The container top of the present invention may be used with a single box or with a container having multiple box subassemblies glued or taped together.

In containers having multi-box subassemblies the container top may cover the entire container assembly. Also, an individual container top may be used to cover each container box subassembly to allow the subassemblies to be later separated for consumer distribution. The container of the present invention may also include a viewing window in outside walls of the container to enable consumers to observe the contents of the container.

BRIEF DESCRIPTION OF THE DRAWINGS

The objects of the present invention and the attendant advantages thereof will become more readily apparent with reference to the following drawings wherein.

DETAILED DESCRIPTION OF THE PREFERRED EMBODIMENT

Figure 1:
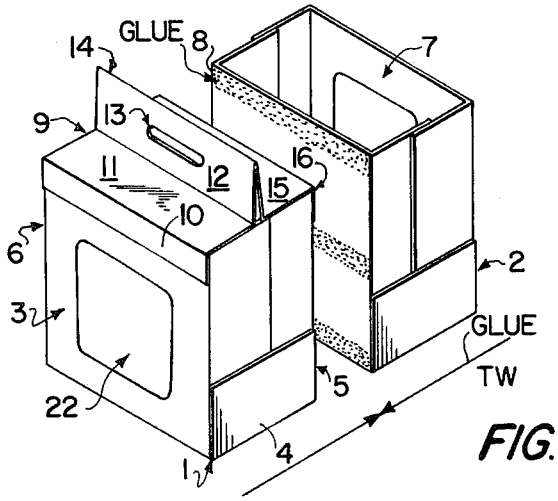
FIG. 1 is an exploded perspective view of the container made in accordance with the present invention which illustrates the combination of two box assemblies which may be joined together to form a single twin-pack assembly.

Referring in detail to FIG. 1 there is illustrated a first corrugated cardboard, generally indicated as 1, made in accordance with the present invention, as well as a second corrugated cardboard box positioned in such a way as to illustrate the relationship of two boxes before they are glued together to make a single container assembly. The first corrugated cardboard box 1 includes a bottom and four sides 3 to 6. A container top, generally indicated as 9, is formed from a single sheet of paperboard, which preferably has a white and smooth external surface.

Figure 2:
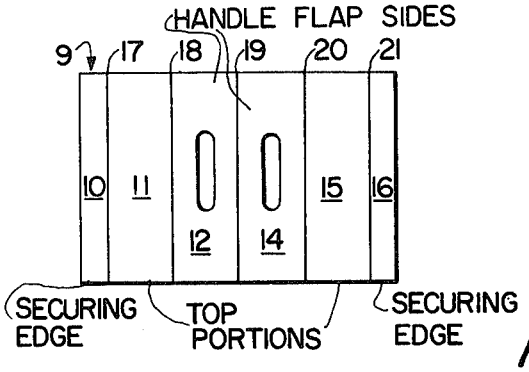
FIG. 2 shows an unfolded blank of the container top of the present invention illustrated in FIG. 1.

The container top, as better illustrated in FIG. 2, includes a first securing edge 10, a first top portion 11 connected to the securing edge 10 along a foldline 17, a first handle flap side 12 connected to first top portion 11 along a foldline 18, a second handle flap side 14 connected to the first handle flap side 12 along a foldline 19, a second top portion 15 connected to the second handle flap side 14 along a foldline 20, and a second securing edge 16 connected to the second top portion 15 along a foldline 21.

The first and second handle flap sides 12 and 14 are provided with handle slots 13 die-cut therein. The assembly of the container top 9 to the first box 1 is best illustrated in relation to FIG. 1. The first securing edge 10 of the container top 9 is attached the side 3 of the first box 1 through the use of an adhesive. The second securing edge 16 of the container top 9 is fixed to the side 5 of the first box 1, also through the use of an adhesive. Thus, by attaching the container top 9 to the first corrugated cardboard container box 1 through the use of an adhesive, the basic container structure of the present invention is formed. Also shown in FIG. 1 is the viewing window 22 provided in the box side 3. This viewing window 22 is die-cut from the corrugated cardboard to allow the consumer to view the contents of the container.

The second box 2 of FIG. 1 is identical to first box 1 previously described.

In FIG. 1, first box 1 and second box 2 are illustrated in their respective positions just prior to attaching them together through the use of an adhesive glue 8. This glueing step would not normally be done until a container top 9 is also affixed to second box 2. The glue would be applied over a limited portion of the opposing box surfaces so that the boxes may be easily separated.

Figure 3:
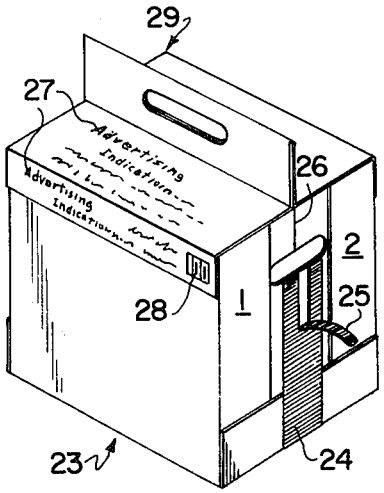
FIG. 3 is an additional embodiment of the present invention wherein a single container top covers more than one box subassembly rather than a single subassembly as in FIG. 1.

Referring to FIG. 3, an additional embodiment of the present invention includes a container assembly 23 formed from the two boxes 1,2 identical to the boxes used in the FIG. 1 embodiment. In the embodiment of FIG. 3 the boxes 1,2 are affixed together, not with glue, but with a tear tape 24. The tear tape 24 includes a tear tape separator 25 which may be pulled to separate the first box 1 from the second box 2 along separation line 26.

In the embodiment of FIG. 3 a single container top 29 covers the entire container assembly 23 including the first box 1 and the second box 2. The container top 29 is formed in an identical manner to the container top 9 of FIGS. 1 and 2. However, the dimensions of this container top 29 are suitably modified to allow the container top 29 to cover the entire container assembly 23. Advertising indicia 27 and uniform product code information may be imprinted onto the paperboard container top 29. This is particularly advantageous since it is difficult to imprint this information on the surface of the corrugated caseboard container assembly 23. As stated hereinbefore the white, smooth surface of paperboard top 9 provides a good background on which colored logo and advertising indicia can be printed. Materials other than paperboard may be utilized if desired for top 9. For example, a strong conventional paper may be used or a plastic sheet material. The main requirement is that the materials chosen having suitable surface textures and colors receiving printed indicia thereon.

It should be understood that the system described herein may be modified as would occur to one of ordinary skill in the art without departing from the spirit and scope of the present invention.

What is claimed is:

1. A package comprising:

a box having only sides and a bottom; and a top including a handle flap portion, a top cover portion, and a pair of securing edge portions, said securing edge portions being adhesively fastened to the top portions of two opposite box sides, said opposite box sides having substantially planar surfaces;

the sole cover of said box consisting of said top.

2. The package of claim 1 wherein said box includes a viewing window provided on at least one side.

3. The package of claim 1 wherein said top includes advertising indicia printed thereon.

4. The package of claim 1 wherein said top includes uniform product code information imprinted thereon.

5. The package of claim 1 wherein said top cover portion includes two top cover portion parts separated by said handle flap portion; and wherein each of said pair of securing edge portions is attached to the edge of each of said top cover portion parts directly opposite to the edge of said parts adjoining said handle flap portion.

6. The package of claim 5 wherein said handle flap portion is folded in half; and wherein handle slots are provided in each half of said handle flap portion.

7. The package of claim 1 wherein said securing edge portions are substantially juxtaposed with the planar top portions of said box sides.

8. The package of claims 1 or 7 wherein said box is formed of corrugated cardboard; and wherein said top is formed of a single sheet of paperboard.

9. A package comprising:

a first box having only sides and a bottom;

a second box having only sides and a bottom;

a first top including a first handle flap portion, a first top cover portion, and a first pair of securing edge portions, said securing edge portions of said first pair being fastened to the top portions of two opposite sides of said first box; and a second top including a second handle flap portion, a second top cover portion, and a second pair of securing edge portions, said securing edge portions of said second pair being fastened to the top portions of two opposite sides of said second box;

said first and second boxes being fastened together to form a box assembly by fastening a side of said first box to a side of said second box.

10. The package of claim 9 wherein said first and second boxes are fastened together by the use of an adhesive.

11. The package of claim 9 wherein said first and second boxes are fastened together using a tear tape.

12. The package of claim 9 wherein at least one of said first and second boxes includes a viewing window provided on at least one side not adjacent to the other box.

13. The package of claim 9 wherein said first and second tops include advertising indicia printed thereon.

14. The package of claim 9 wherein said first and second tops include uniform product code information imprinted thereon.

15. The package of claim 9 wherein said first top cover portion includes two first top cover portion parts separated by said first handle flap portion, said first pair of securing edge portions is attached to the edge of each of said first top cover portion parts directly opposite to the edges of said parts adjoining said first handle flap portion, and wherein said second pair of securing edge portions is attached to the edge of each of said second top cover portion parts directly opposite to the edge of said parts adjoining said second handle flap portion.

16. The package of claim 15 wherein said first and second handle flap portions are folded in half; and wherein handle slots are provided in each half of said first and second handle flap portions.

17. The package of claim 9 wherein said securing edge portions of said first top are fastened to said two opposite sides of said first box using an adhesive; and wherein said securing edge portions of said second box are fastened to said two opposite sides of said second box using an adhesive.

18. The package of claim 9 wherein said first and second boxes are formed out of corrugated cardboard; and wherein said first and second tops are each formed out of a single sheet of paperboard.

19. The package of claim 9 wherein said first and second tops are the sole covers for their respective first and second boxes.

20. A package comprising:

a box assembly including at least two boxes, each having only sides and a bottom, said boxes being fastened together by attaching an attachment side of each box to an attachment side of the other box, said box assembly having sides and a bottom; and a top including a handle flap portion, a top cover portion, and a pair of securing edge portions, said securing edge portions being fastened to the top portions of two opposite box assembly sides parallel to said attachment sides of said boxes.

21. The package of claim 20 wherein said boxes are fastened together by the use of an adhesive.

22. The package of claim 20 wherein said boxes are fastened together using a tear tape.

23. The package of claim 20 wherein at least one of said box sides forming part of one of said box assembly sides includes a viewing window.

24. The package of claim 20 wherein said top includes advertising indicia printed thereon.

25. The package of claim 20 wherein said top includes uniform product code information imprinted thereon.

26. The package of claim 20 wherein said top cover portion includes two top cover portion parts separated by said handle flap portion; and wherein each of said pair of securing edge portions are attached to the edge of each said top cover portion parts directly opposite to the edge of said parts adjoining said handle flap portion.

27. The package of claim 26 wherein said handle flap portion is folded in half; and wherein handle slots are provided in each half of said handle flap portion.

28. The package of claim 20 wherein said securing edge portions are fastened to said two opposite box assembly sides using an adhesive.

29. The package of claim 20 wherein said boxes are formed out of corrugated cardboard; and wherein said top is formed out of a single sheet of paperboard.

30. The package of claim 20 wherein said top is the sole cover for said boxes.

31. The package of claim 20 wherein said securing edge portions are substantially juxtaposed with the planar top portion of said two opposite box assembly sides.

* * * * *